US005829334A

United States Patent [19]

Evans et al.

[11] Patent Number: 5,829,334

[45] Date of Patent: Nov. 3, 1998

[54] LEVER OPERATED PUNCH WITH PUNCH HEAD ADJUSTMENT ARRANGEMENT

[75] Inventors: Alfred J. Evans, Lake In the Hills; Balaji Kandasamy, Chicago, both of Ill.

[73] Assignee: Acco Brands, Inc., Lincolnshire, Ill.

[21] Appl. No.: 802,611

[22] Filed: Feb. 19, 1997

Related U.S. Application Data

[62] Division of Ser. No. 516,022, Aug. 17, 1995.

[51] Int. Cl.[6] ..... B26D 5/08

[52] U.S. Cl. ..... 83/618; 83/634

[58] Field of Search ..... 83/618, 167, 633, 83/634

[56] References Cited

U.S. PATENT DOCUMENTS

| | | | |
|---|---|---|---|
| 1,655,315 | 1/1928 | Finley | 83/618 X |
| 2,137,716 | 11/1938 | Fass | 83/618 X |
| 2,244,660 | 6/1941 | Carpenter | 83/167 |
| 2,474,344 | 6/1949 | Carpenter | 83/167 |
| 2,534,094 | 12/1950 | Yerkes | 83/549 X |
| 3,073,199 | 1/1963 | Yerkes | 83/633 X |
| 3,392,913 | 7/1968 | Neilsen | 83/633 X |
| 4,036,088 | 7/1977 | Ruskin | 83/167 |
| 4,656,907 | 4/1987 | Hymmen | 83/167 X |
| 4,688,457 | 8/1987 | Neilsen et al. | 83/618 X |
| 4,898,055 | 2/1990 | Neilsen et al. | 83/618 X |

OTHER PUBLICATIONS

Office Depot Catalog 27, Fall, 1995, "Acco Lever Paper Punch", includes picture and description of adjustable 3–hole paper punch, Part #996–926, Aug. 1995.

Office Depot Catalog 33, Fall 1997, "Acco Model 20L Lever Adjustable Punch", includes picture and description of adjustable 3–hole paper punch, Part #996–926, Aug. 1997.

*Primary Examiner*—Maurina T. Rachuba
*Attorney, Agent, or Firm*—Pennie & Edmonds LLP

[57] ABSTRACT

A hand-operated punch with adjustable assembly punch units and a slipper to receive punched out discs in which the assembly units are adjustable from the bottom through an opening in the slipper. The punch includes a strengthening flap configuration and the assembly units slide but do not turn during adjustment.

3 Claims, 9 Drawing Sheets

LEVER OPERATED PUNCH WITH PUNCH HEAD ADJUSTMENT ARRANGEMENT

This is a division, of application Ser. No. 08/516,022, filed Aug. 17, 1995.

BACKGROUND OF THE INVENTION

Punches with slidable slippers are old. Slippered punches with adjustable punch stations are also old but removal of the slipper is required to accomplish adjustment.

SUMMARY OF THE INVENTION

Broadly, the present invention is a slippered adjustable hand-operated punch with adjustment accomplished from the bottom of the punch without slipper removal. The flap handle is configured for added strength.

DESCRIPTION OF THE PREFERRED EMBODIMENT

Figure 1:
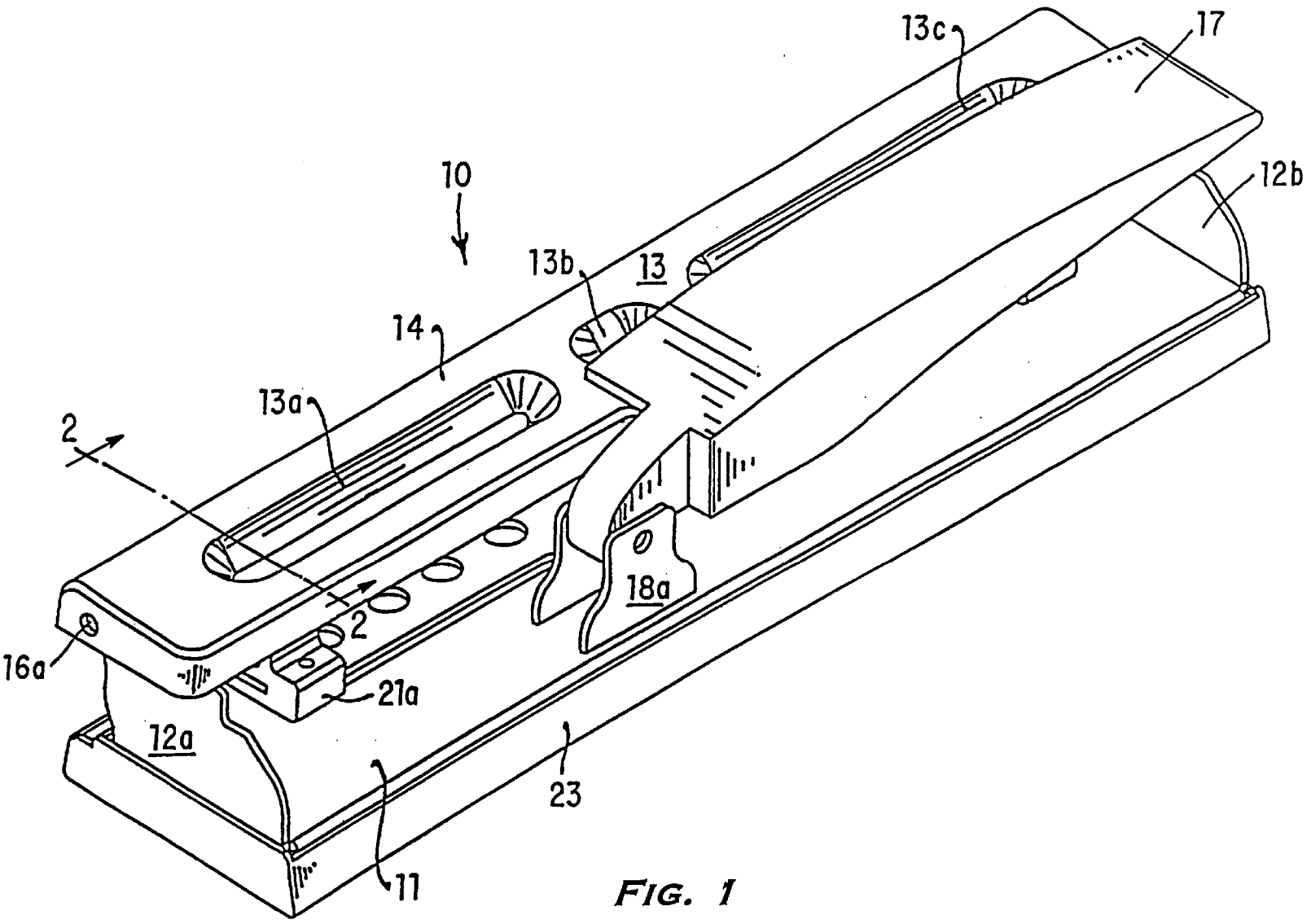
FIG. 1 is a perspective view of the punch of the present invention having a handle and a lever.

In FIGS. 1–4, punch 10 includes base 11, end uprights 12*a*, 12*b*, handle 14 including upper planar surface 13, handle depressions 13*a*, 13*b*, 13*c* mounted for pivoting around pivot pins 16*a*, 16*b* on end uprights 12*a*, 12*b*. Lever 17 is pivotally mounted on brackets 18*a*, 18*b*. Also shown are punch assembly heads 21*a*, 21*b*, 21*c* and slipper 23 mounted on base rails 11*a*, 11*b*. Punch assembly heads 21*a*–c include punch pins P and curled projections 34*a*–c which reside in groove 40 to prevent turning of punch assembly heads 21*a*–c as they are translated (see also FIG. 7).

Figure 2:
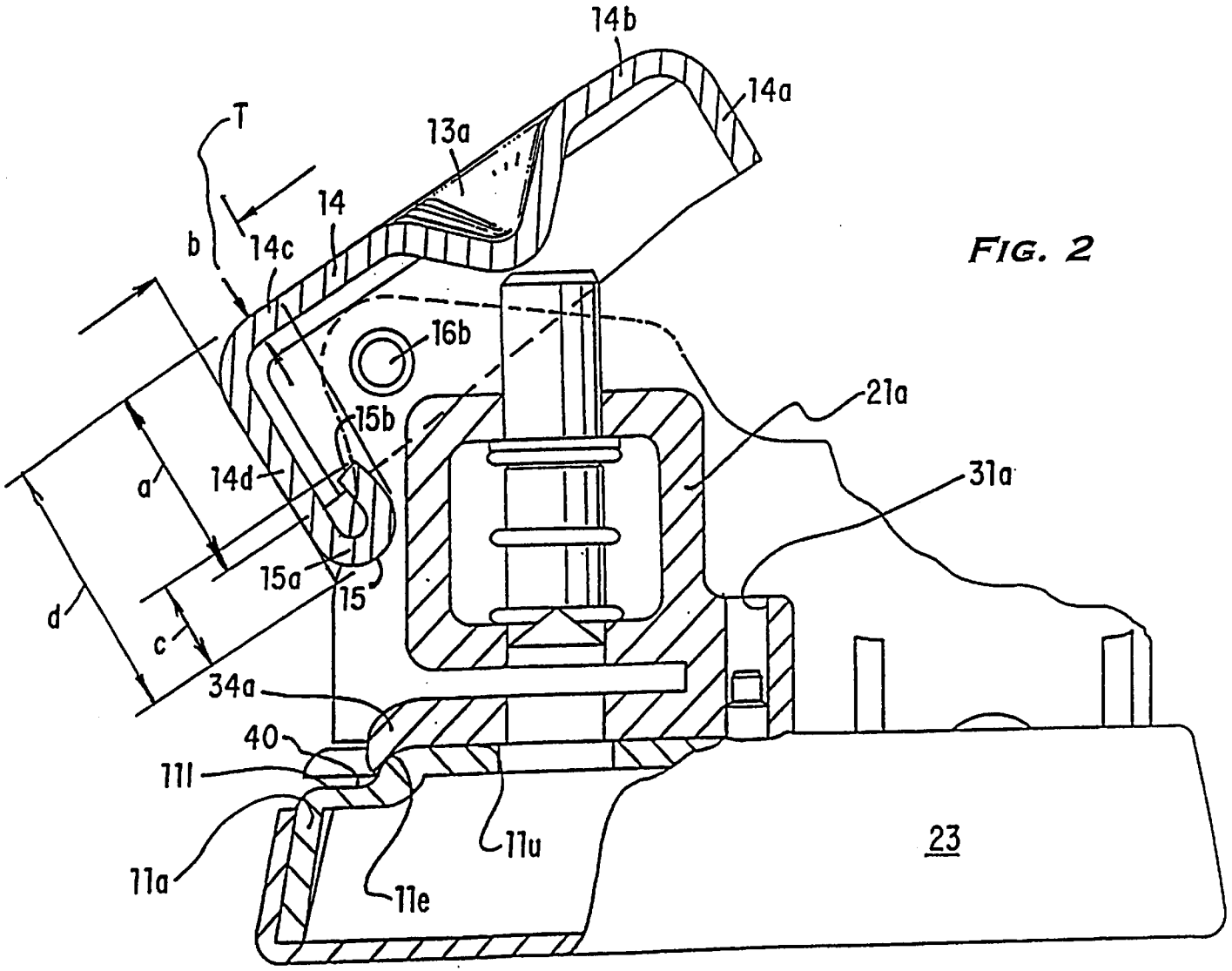
FIG. 2 is a sectional view taken along line 2—2 of FIG. 1 showing the flap handle's reverse curl.
Figure 3:
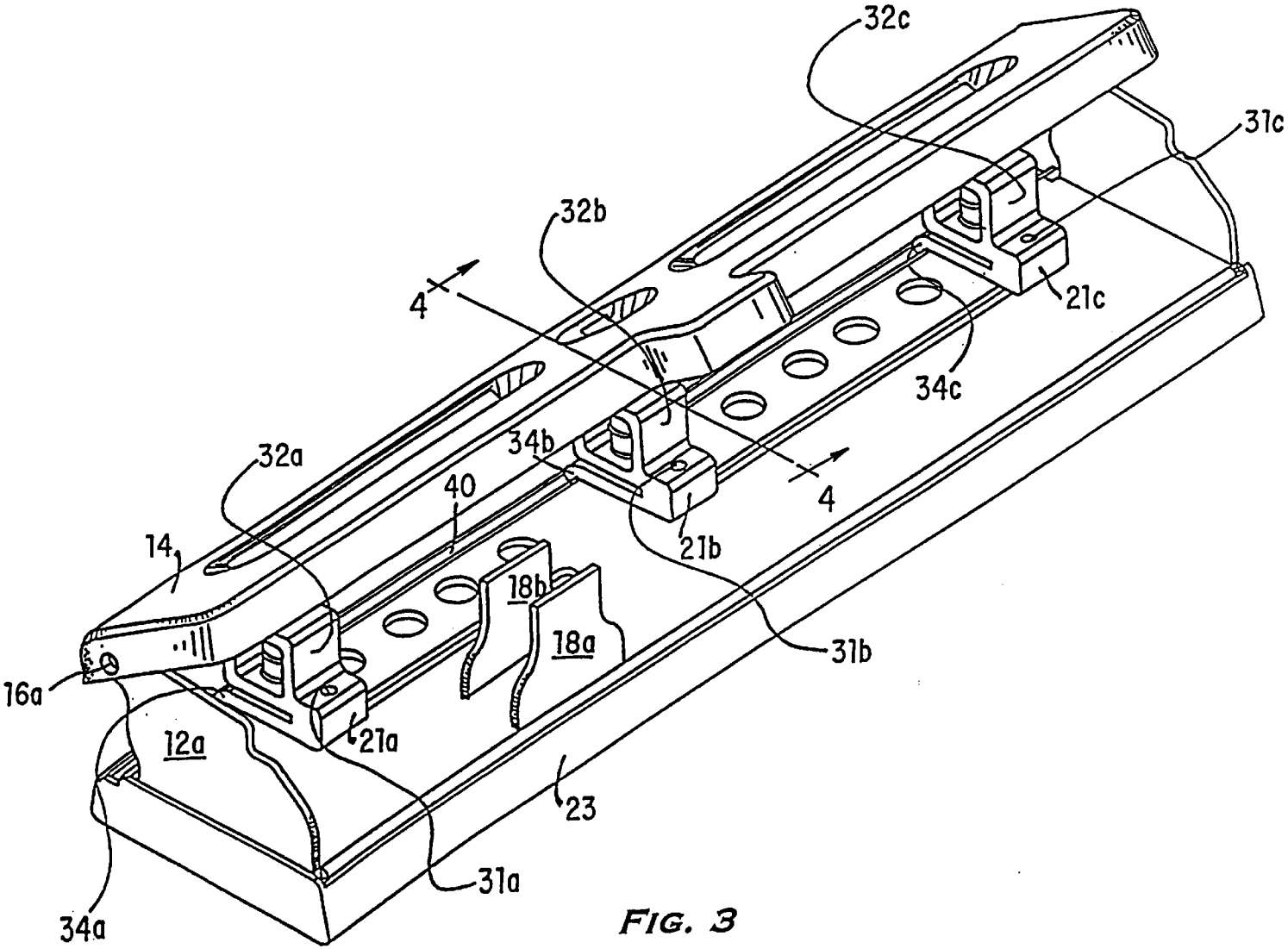
FIG. 3 is a perspective view of the punch with lever removed.

Turning in particular to FIG. 2, handle 14 is formed of a sheet metal and comprises remote flange portion 14*a* substantially perpendicular to upper planar surface 13, (remote from pivot pins 16*a*, 16*b*); remote planar portion 14*b*, handle depression 13*a*, near planar portion 14*c*; near flange portion 14*d* perpendicular to upper planar surface 13 and reverse curl portion 15. Reverse curl portion 15 functions to stiffen and otherwise strengthen handle 14 and includes arc portion 15*a* and upright lip portion 15*b*.

The sheet metal of handle 14 has thickness T. Table 1 below outlines ranges of handle 14 portions in relationship to thickness T.

TABLE 1

| Portion(s) | Dimension | Range |
|---|---|---|
| 1. Near flange portion | a | 6 T–8 T |
| 2. Curl portion width | b | 2.5 T–4 T |
| 3. Curl portion depth | c | 2.5 T–4 T |
| 4. Near flange portion plus depth of curl portion | d | 9 T–11 T |

Figure 4:
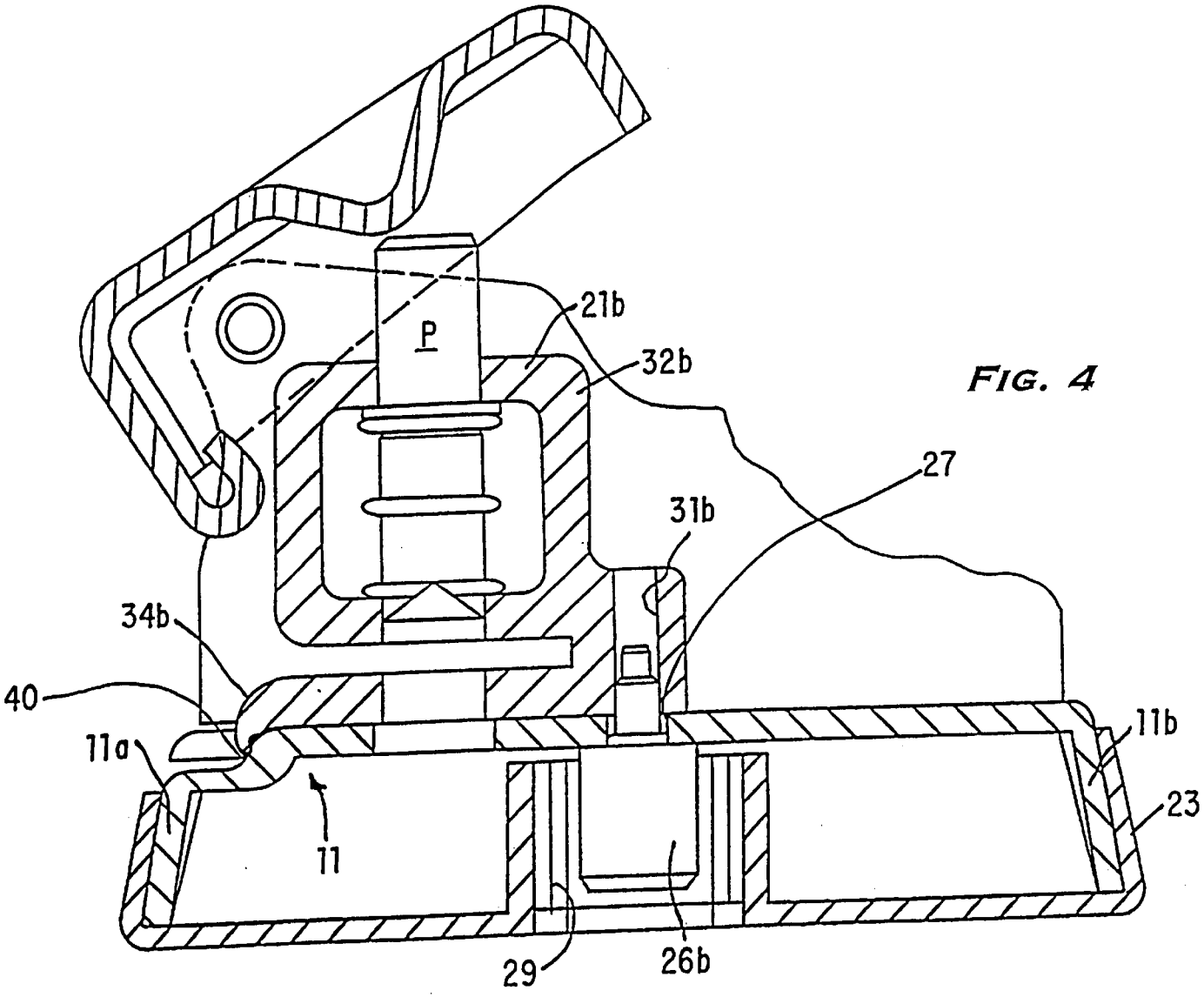
FIG. 4 is a sectional view along line 4—4 of FIG. 3.
Figure 5:
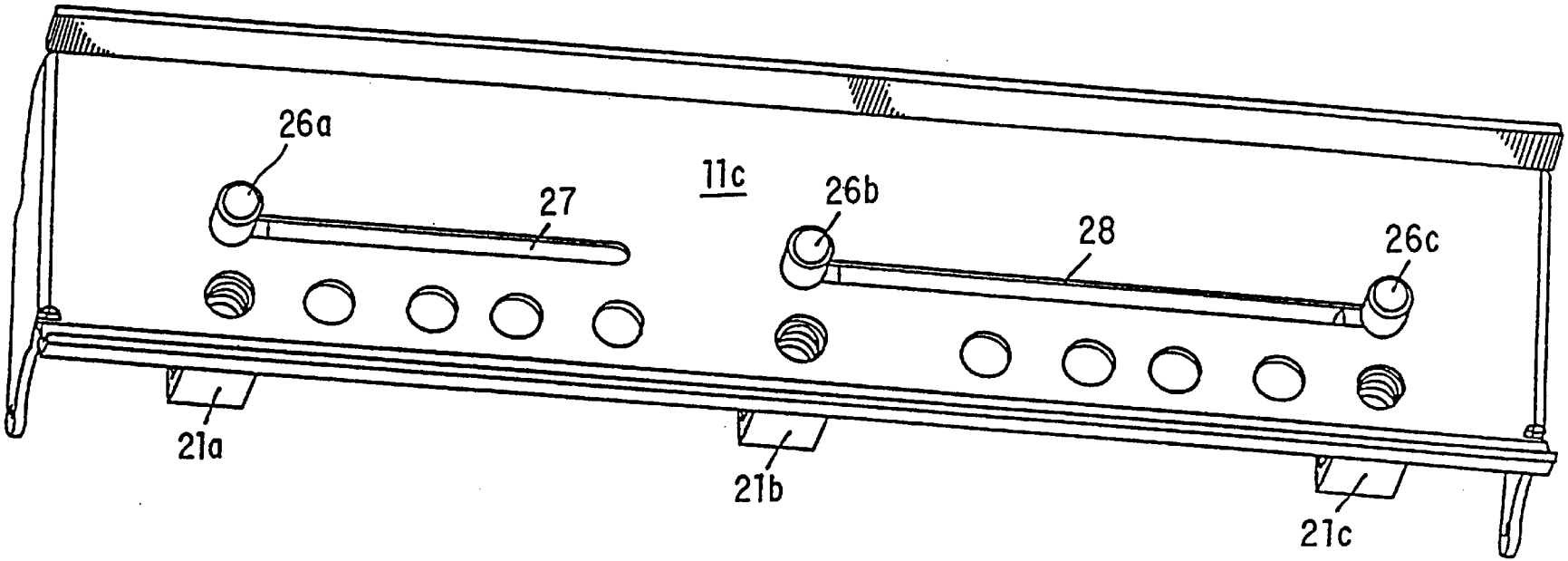
FIG. 5 is a bottom perspective view of the punch with slipper removed.
Figure 6:
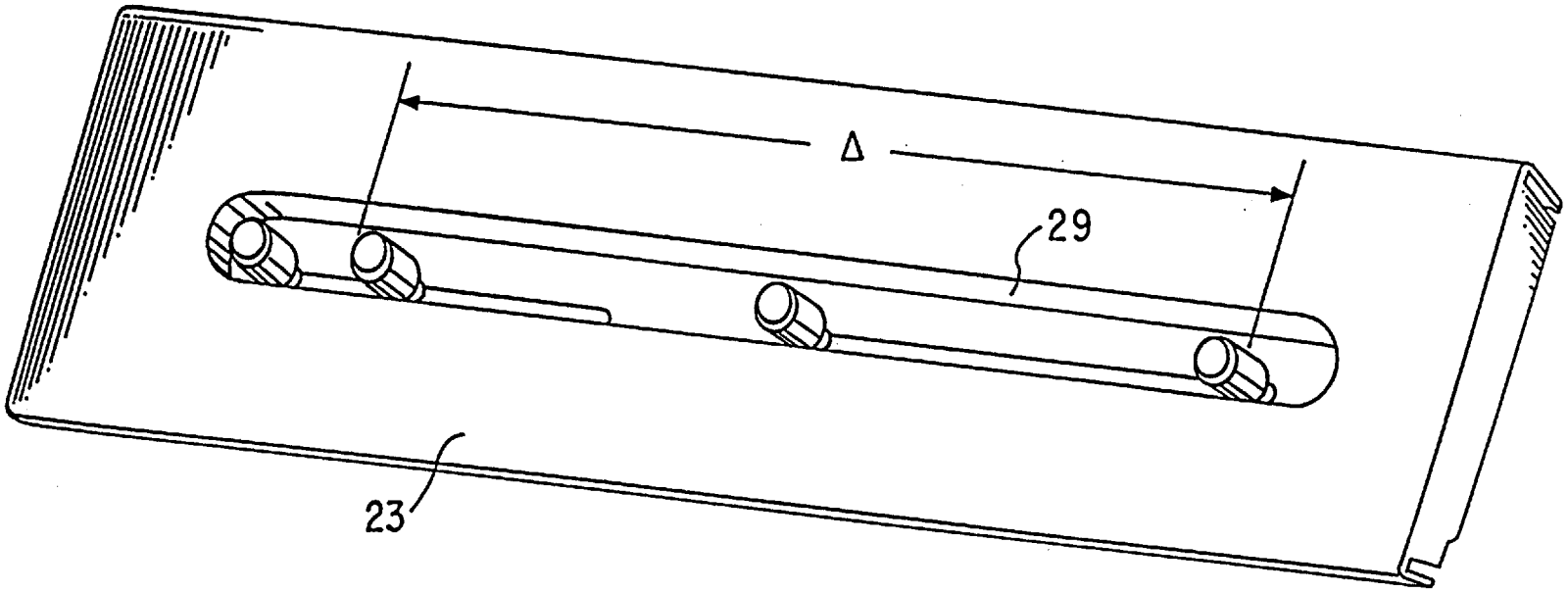
FIG. 6 is a partial perspective bottom view of the punch with the slipper installed.

Turning to FIGS. 4–8, it is seen that punch assembly heads 21*a*, 21*b* and 21*c* are adjustable using retaining screws 26*a*, 26*b* and 26*c* which travel in adjustment slots 27, 28 (FIG. 5) while the curled projections 34*a*–c travel in the longitudinal groove 40. Groove 40 is a longitudinal area below upper base surface 11*u* and above a lower base surface 111. The outer periphery of the upper surface is defined, in part, by the corner between the lower base surface 111 and the base rail 11*a*. Curled projections 34*a*–c extend beyond and below upper base surface 11*u* which permits the curled projections 34*a*–c to move back and forth in groove 40 during adjustment of the punch assembly heads and while preventing rotation of the heads 21*a*–c during their loosening. If a punch assembly head 21*a*–c attempts to rotate, its curled projection 34*a*–c will engage base edge lie to prevent such rotation. Curled projections 34*a*–c may be of other shapes but a curved curled shape is preferred. The retaining screws 26*a*–c are threadedly engaged in threaded housing openings 31*a*, 31*b* and 31*c* (FIG. 4). Punch pin P is shown in FIG. 4. Base bottom 11*c* is shown in FIG. 5. Slipper 23 has a center opening 29 to permit access to the retaining screws 26*a*–c without removing the slipper 23.

Figure 7:
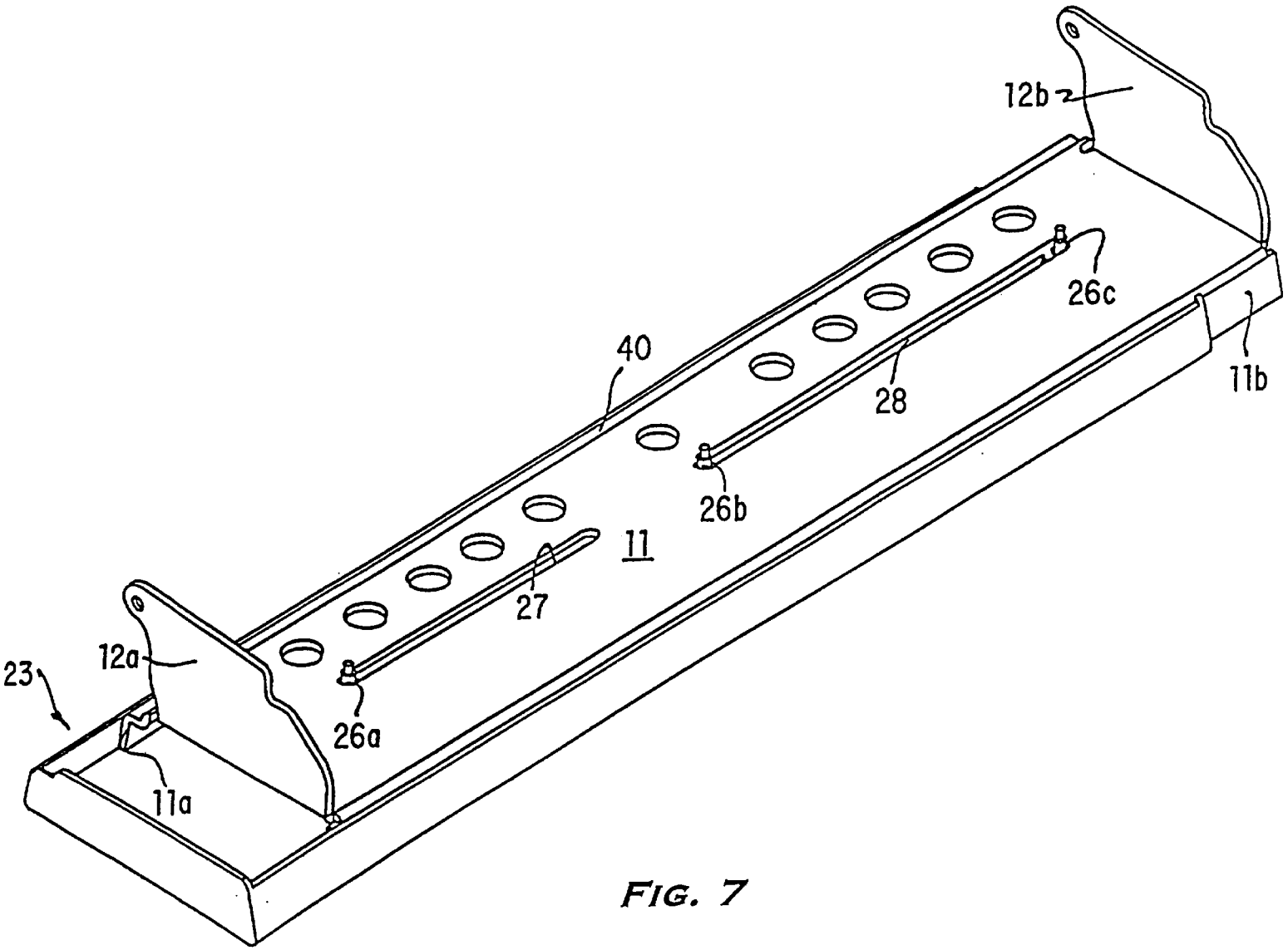
FIG. 7 is a top perspective view of the base with the slipper extended for emptying.

FIG. 7 shows the slipper 23 slid open for emptying and further shows the base rail 11*a*, 11*b*, end uprights 12*a*, 12*b*, slots 27, 28, retaining screws 26*a*–c, and groove 40.

Figure 8:
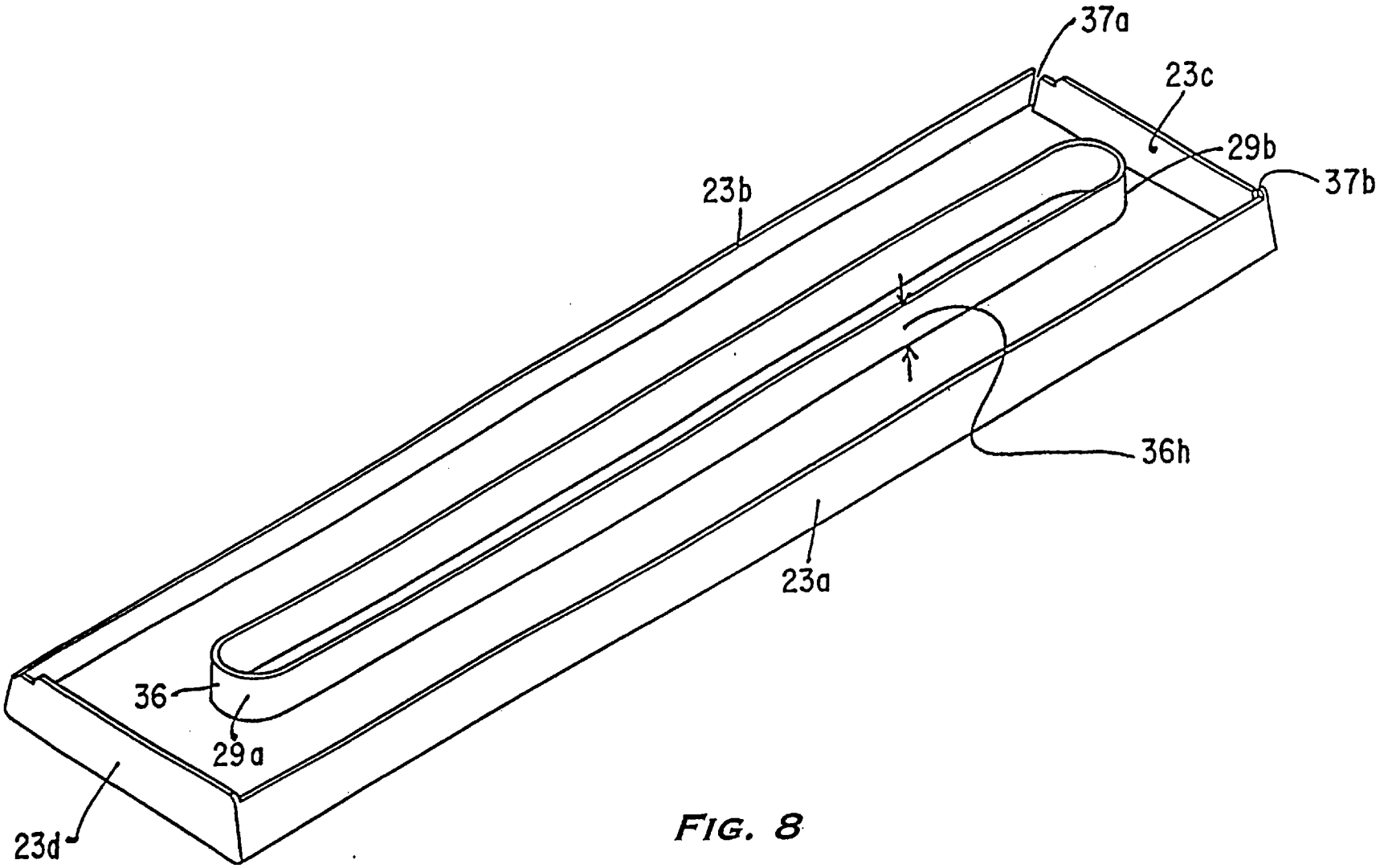
FIG. 8 is a top perspective view of the slipper.

In FIG. 8, the slipper's center opening 29 is bounded by cowling 36 having ends 29*a*, 29*b* which cowling 36 has a height 36*h* sufficient to nearly abut the base bottom 11*c* to prevent paper punch outs or chips from escaping and exiting through center opening 29. Also shown are slipper flanges 23*a*, 23*b* and slipper slotted end 23*c*, and slipper closed end 23*d*. Slots 37*a*, 37*b* permit the slipper 23 to be slid open without removal from the base rails 11*a*, 11*b*. When slipper 23 is slid open, end 29*a* of the cowling 36 engages retaining screw 26*c* to limit its travel. Center opening 29 is longer than the distance (D) between outside retaining screws 26*a* and 26*c* to permit sliding of the slipper 23 relative to the base 11. The length of the opening 29 is less than the overall length of the slipper 23 so that paper punch outs which are all deposited on one side of cowling 36 can migrate past ends 29*a*, 29*b* to the other side as punch 10 is handled and manipulated.

Figure 9:
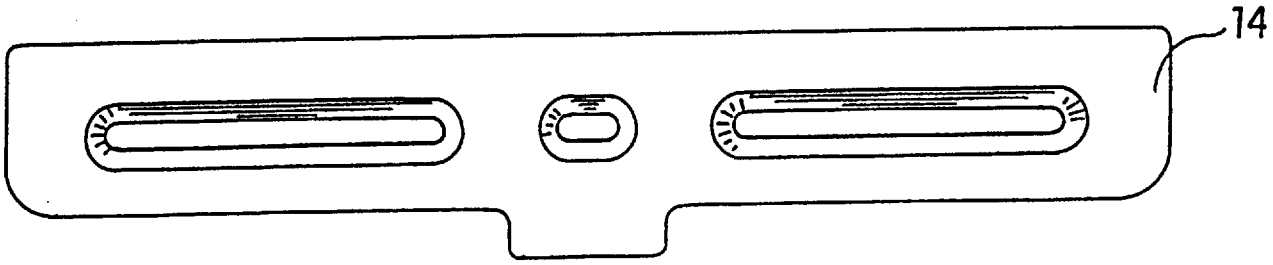
FIG. 9 is a plan view of the flap handle.
Figure 10:
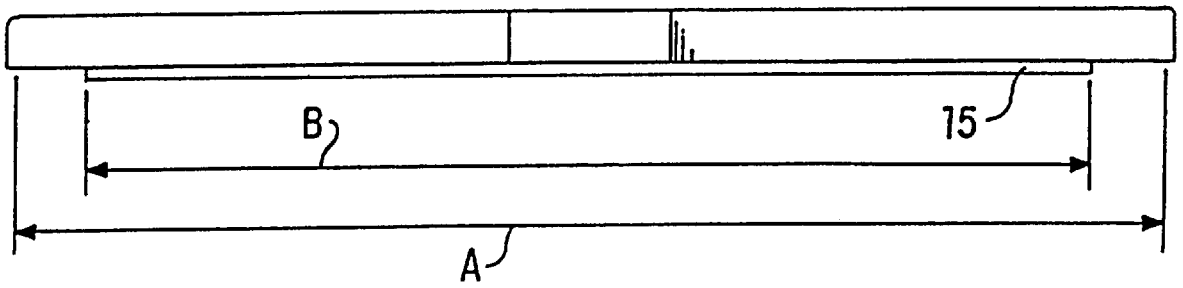
FIG. 10 is an elevational view of the handle viewed from the reverse curl edge.

Finally in FIGS. 9 and 10, the reverse curl portion 15 of handle 14 has a length B which is less than the overall length A of handle 14. Preferably, length B is at least 60% of length A.

We claim:

1. A punch comprising:

a) a base having an outer periphery and an upper base surface with a base edge extending along a predetermined direction;

b) a plurality of punch assembly heads slidably mounted on said upper base surface of said base for movement along a path extending parallel to said predetermined direction and to selected locations on said base;

c) a projection on each of said punch assembly heads disposed adjacent said base edge and projecting below said upper base surface;

d) a groove positioned below said upper base surface, with the projection of each of said punch assembly heads received in said groove; and e) the projection of each of said punch assembly heads, and said groove being shaped to engage each other and prevent turning of said punch assembly heads as said punch assembly heads are moved along said path.

2. The punch of claim 1 wherein:

a) said base includes a lower base surface spaced below said upper base surface to define an area therebetween; and b) said groove is defined by said area.

3. The punch of claim 2 wherein:

a) said base edge has a curved shape; and b) each said projections has a curved shape complimentary to and engaging against said base edge.

* * * * *